US005768841A

United States Patent [19]

Swartz et al.

[11] Patent Number: 5,768,841

[45] Date of Patent: Jun. 23, 1998

[54] WALLBOARD STRUCTURE

[75] Inventors: Allan J. Swartz, Orange; Gregory Kulpa, Tustin, both of Calif.

[73] Assignee: Swartz & Kulpa, Structural Design and Engineering, Tustin, Calif.

[21] Appl. No.: 687,834

[22] Filed: Jul. 26, 1996

Related U.S. Application Data

[63] Continuation of Ser. No. 371,859, Jan. 12, 1995, abandoned, which is a continuation of Ser. No. 47,706, Apr. 14, 1993, abandoned.

[51] Int. Cl.[6] ..... F04B 1/74

[52] U.S. Cl. ..... 52/281; 52/407.4; 52/408; 52/404.2; 52/309.13

[58] Field of Search ..... 52/281, 282.1, 52/282.3, 282.4, 309.4, 309.5, 309.12, 309.15, 403, 404.2, 406, 407, 408, 410, 376, 377, 746.1, 481.1; 428/703, 537.7, 469

[56] References Cited

U.S. PATENT DOCUMENTS

| | | | |
|---|---|---|---|
| 851,343 | 4/1907 | Caldwell | 52/630 |
| 2,485,648 | 10/1949 | Norquist . | |
| 2,797,448 | 7/1957 | Revell et al. . | |
| 3,324,617 | 6/1967 | Knight et al. | 52/404 |
| 3,492,196 | 1/1970 | Moore | 52/309.12 |
| 3,654,067 | 4/1972 | Klein . | |
| 3,763,614 | 10/1973 | Hyde et al. | 52/408 |
| 4,037,381 | 7/1977 | Charles | 52/281 |
| 4,126,725 | 11/1978 | Shiflet | 428/110 |
| 4,231,205 | 11/1980 | Wendt | 52/481.1 |
| 4,346,543 | 8/1982 | Wilson et al. | 52/404 |
| 4,567,100 | 1/1986 | Pickett et al. | 52/309.14 |
| 4,571,909 | 2/1986 | Berghuis et al. | 52/404 |
| 4,646,494 | 3/1987 | Saarinen et al. | 52/232 |
| 4,817,355 | 4/1989 | Tilsley et al. | 52/410 |
| 4,869,037 | 9/1989 | Murphy | 52/309.15 |

OTHER PUBLICATIONS

Radiation Protection Materials–Brochure, Ray–Bar Engineering Corp, pp. 1–3.

*Primary Examiner*—Carl D. Friedman
*Assistant Examiner*—Winnie Yip
*Attorney, Agent, or Firm*—Harold L. Jackson

[57] ABSTRACT

A wallboard structure is disclosed having a metal sheet attached by means of an adhesive to a wallboard panel, such as a gypsum panel. The wallboard structure is attached to the framing studs of a building with the metal sheet adjacent the studs. The metal sheet resists in-plane or shear loads imposed of the framing structure of the building due to exterior environmental conditions, and thereby helps keep the wallboard panel from cracking.

11 Claims, 1 Drawing Sheet

WALLBOARD STRUCTURE

This application is a continuation of application Ser. No. 08/371,859, filed on Jan. 12, 1995, now abandoned which was a continuation of application Ser. No. 08/047,706, filed on Apr. 14, 1993, now abandoned.

BACKGROUND OF THE INVENTION

1. Field of the Invention

The invention relates generally to building construction and more particularly to wallboard structures.

2. Description of Related Art

Since the turn of the century many laminate type structures have been employed in the construction of buildings. For example, a patent issued of Caldwell in 1907 discloses a building sheet wherein a metal sheet has a pliable sheet placed on it, which pliable sheet is bent or folded within the angled bends or folds of the metal sheet. The corrugated metal formed an exterior wall or roof surface, while the inner pliable sheet, which could be tar paper or plastic, kept any rain or other elements from seeping through the cracks in the wall or roof.

In a patent issued in 1947 to Norquist, a metal clad panel is disclosed having an exterior metal sheet bonded to a base sheet of wood and the like. The metal provides a finished exterior surface for table tops, counters, cabinets, boxes, fixtures and building interiors. In 1957 Revell et al. patented a metallic sheet-faced panel comprising metal sheet on plywood or composite wood structure. The metal exterior in this panel also provides the outside appearance for the finished structure.

In 1972, a patent to Klein discloses a building wall structure for a house wherein an interior plastered house wall is overlaid with a covering having a front paper ply and a metal foil back ply. This covering is adhered to the wall by an adhesive composition which facilitates both the application of the covering to a wall and its removal from the wall years later. The foil provides a barrier to prevent passage of moisture through the wall and also acts as a heat insulator.

A laminate wall structure patented by Pickett et al. in 1986 prevents forced entry and ballistic or explosives forces. This laminated wall structure comprises an outer steel sheet, hardwood, polycarbonate plastic, a thin layer of armor steel and an inner steel sheet bonded together in that order into a laminated panel. A less dramatic laminated structure was patented by Saarinen et al. in 1987 for wall and roof systems, which comprises a core of expanded polystyrene or polyurethane foam faced with a layer of particle board of gypsum board covered by a layer of steel fastened to the particle board of gypsum. During a fire, gases from the particle board can escape from the interior of the panel but air exterior to the panel is prevented for entering which extends the load-bearing capacity of the panel during a fire. In yet another entry preventing type wall structure, lead backed gypsum wallboard has been employed in medical imaging labs and other medical facilities in order to prevent radiation, such as generated by an X-ray machine, from escaping into other areas of a building and injuring personnel.

Today wall construction for houses and buildings generally consist of attaching plywood sheets to the wall framing studs and attaching a wallboard panel to the plywood sheets. The wallboard panel is typically a fibrous material, commonly prepared with gypsum, made in thin flat slabs for making or covering walls and ceilings. The attached plywood sheets provide a diaphragm action. Disadvantageously with this wall structure, even when not needed in certain areas of a wall the plywood must be installed across the entire wall to avoid a drastic change in wall thickness. This results in a waste of wood product, a limited natural resource, where it is not needed. Additionally, plywood sheets and wallboard sheets must be attached in separate wall sheathing procedures; the plywood being attached first then the wallboard being attached over the plywood. Plywood sheets, which can be large and very heavy, can be difficult to handle and install and therefore add to the difficulty and expense of building construction.

As an alternative to using plywood sheets, steel straps have been installed in an "X" configuration to the wall framing studs to brace the building framework. The wallboard is attached over the steel straps. This wall structure, however, is also labor intensive to construct and requires special plate brackets to receive the straps. While the steel straps need only be employed in desired locations along the wall frame, where employed, there may be bumps in the outer wallboard surface which is undesirable.

These above described composite structures provide unique solutions for specific problems in the building industry. However, none deal with simplifying the construction of houses or buildings in today's environment of wood scarcity and high labor costs. A simple wall structure which would be easy to handle, relatively inexpensive and strong has eluded the building industry for some time now.

Summary of the Invention

It is therefore an object of the invention to provide a wall structure that is simple and easy to make yet strong.

It is another object of the invention to provide a wall structure that does not necessitate the use of wood products.

It is still a further object of the invention to provide a wall structure that is easy to handle and use in the construction of buildings and houses.

A composite wallboard structure according to the present invention comprises a wallboard panel having a thin flat sheet of metal attached thereto by an adhesive material. The composite wallboard structure is made by attaching a sheet of metal to a wallboard panel, such as gypsum wallboard for example. The attaching means may be adhesive, such as glue, which provides at least a temporary attachment of the steel sheet to the wallboard. Such a wallboard composite structure can readily be handled and attached to the framework of a house or building.

DESCRIPTION OF PREFERRED EMBODIMENTS

Figure 1:
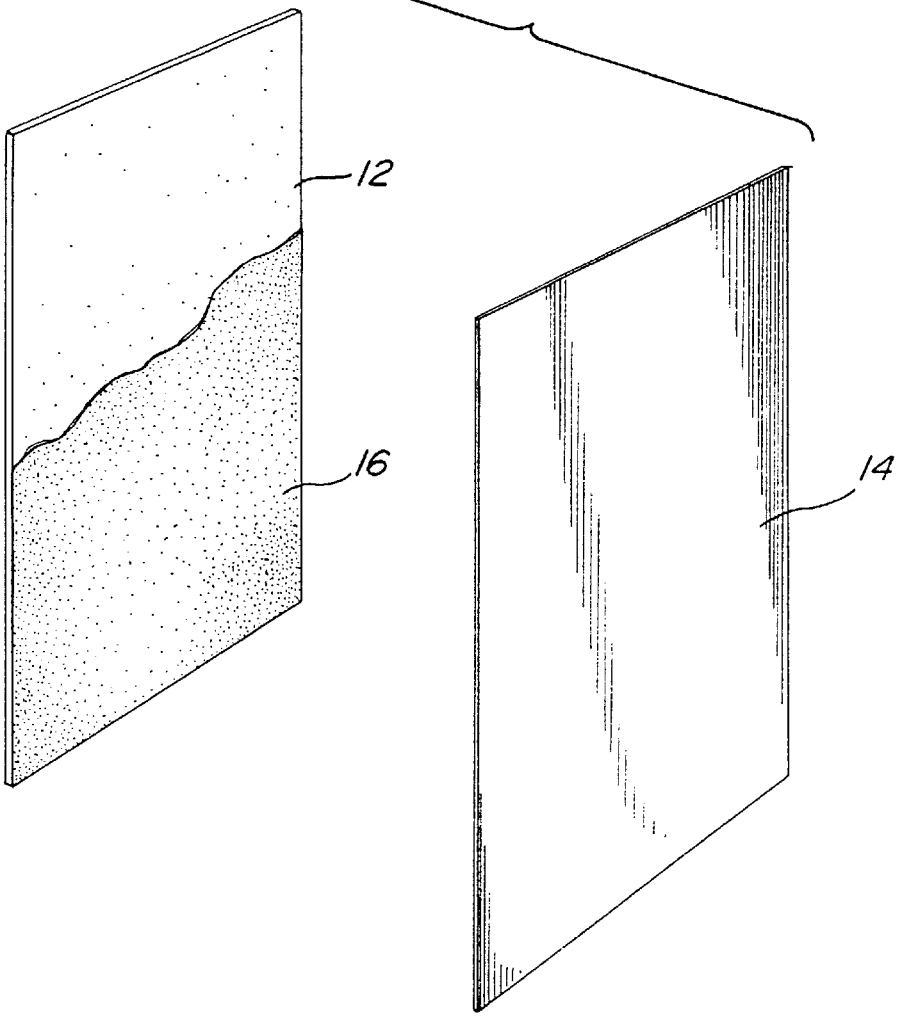
FIG. 1 shows a perspective view of the elements of a composite wallboard structure of the present invention before assembly thereof.
Figure 2:
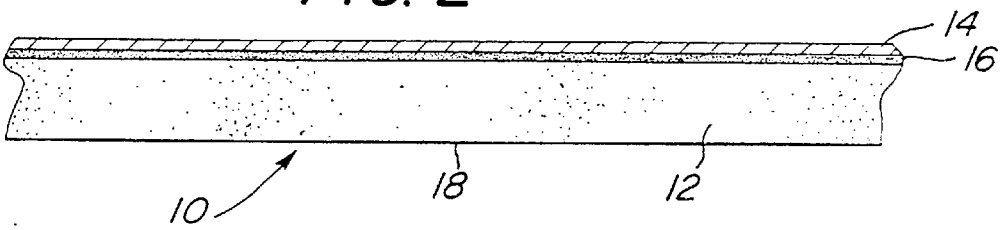
FIG. 2 shows a partially broken away cross-sectional view of the assembled composite wallboard structure of FIG. 1, made in accordance with the principles of the invention.

Referring now with more particularity to the drawings, wherein like or similar parts are designated by the same numerals throughout the various figures, a composite wallboard structure 10 is illustrated in FIGS. 1 and 2, which comprises wallboard panel 12 and metal sheet 14 with an adhesive 16 therebetween. Wallboard 12 may be any architectural wallboard product which is currently available or developed in the future and used to sheath wall studs in building or housing construction. Typical wallboard panels may be gypsum wallboard, cementous boards (which may be sold under trade names Durock (TM) or Wonderboard (TM)), fiber reinforced gypsum (which may be sold under the trade name Dens Glass (TM)) or such other architectural wallboard panel products which are used for building architectural finishes. Wallboard panel 12, such as illustrated in FIG. 1, may have paper, fiber glass mesh or cardboard sheets disposed over a center or core material, which core materials are generally brittle, low strength materials.

Wallboard panel 12 may be substantially quadrangular, but often will have a rectangular shape. Metal sheet 14 is selected to have an overall extent similar to that of wallboard panel 12 to which it will be mated. Metal sheet 14 may be made of any suitable metallic sheet material. The thickness of metal sheet 14 may be in the range of about 0.015 and 0.06 inches, which in many construction applications will provide good strength; however, thinner or thicker sheets may also be used as desired. Furthermore, while for the preferred embodiment has been directed to a metal sheet, other thin high strength materials, such as plastic for example, may also be used.

Metal sheet 14 is preferably at least temporarily affixed to wallboard panel 12 by an adhesive 16 applied to one of the mating major surfaces. Other attachment means of affixing wallboard 12 to steel sheet 14, such as double sided tape, may be employed also. The adhesive 16 may be epoxy or glue, and may be applied by various means such as brushing or spraying, for example. Further, the adhesive may be applied to a portion or portions of one or both of the major surfaces. However, adhesive 16 is preferably spread over the extent of one of the major surfaces of one of either wallboard panel 12 or metal sheet 14 and is a water soluble latex based glue. The amount of adhesive applied to adhere the wallboard panel 12 and metal sheet 14 together is an amount at least sufficient to hold these two members together such that the composite wallboard structure can be handled and constructed into a building wall structure. In other words, the adhesive applied between the wallboard panel 12 and metal sheet 14 must be of sufficient quantity to hold these two members together while the composite structure is being handled, shipped and attached to building wall framing studs, typical building construction processes.

Wallboard structure 10 could be made by automated processes. For example, a wallboard panel 12 could be manufactured and provided by automated machinery well known in the industry. Wallboard panel 12 could continue its processing by spraying one of its surfaces with an adhesive utilizing a spraying device stationed over wallboard panel 12. Metal sheet 14 can thereafter be laid on the adhesive by a robotics mechanism.

Figure 3:
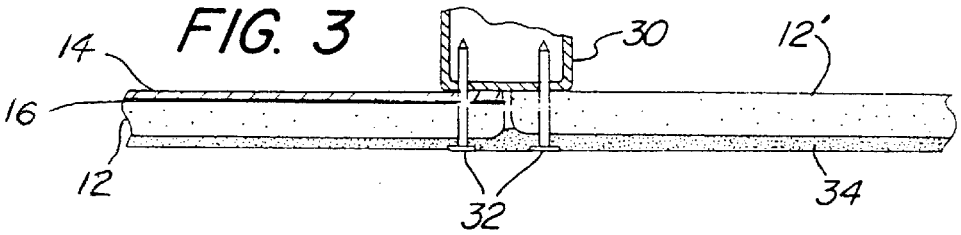
FIG. 3 shows a partially broken away cross-sectional view of a wall stud framework employing a composite wallboard structure and a conventional wallboard panel product arranged side by side.

FIG. 3 illustrates a composite wallboard structure attached to studs 30 of a skeletal framing structure of a building. The composite wallboard structure 10 may be attached to studs 30 by screws 32, for example. A wallboard panel 12' is shown attached next to wallboard structure 10 illustrating one of the advantages of this invention, namely the relatively little change in thickness of the wall. It similarly may be attached by screws 32. The exterior surface provided by the wallboard panel 12 and 12' may be worked in any manner desired to provide a quality finished surface. For example, the exterior surface can be finished with a plastering material 34 such as stucco to provide a uniform finished surface.

Once wallboard 10 is attached to the framing structure of a building, such as studs 30, metal sheet 14 may detach from wallboard panel 12. Metal sheet 14 which is secured adjacent to the framing studs 30 will assist the building framework in resisting in-plane or shear loading stresses that are exerted on the building structure due to environmental conditions such as wind and earthquakes. The metal sheet 14 thus will help keep the wallboard panel 12 from cracking due to in-plane or shear loads.

The above-described detailed description of a preferred embodiment described the best mode contemplated by the inventors for carrying out the present invention at the time this application was filed and is offered by way of example and not by way of limitation. Accordingly, various modification may be made to the above-described preferred embodiment without departing from the scope of the invention. It should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

We claim:

1. A building shear wall structure for accommodating in-plane or shear loads imposed on the wall structure comprising:

a plurality of framing studs forming a part of the building;

a plurality of composite wallboard panels, each composite panel comprising only one wall board panel and one thin sheet of high strength material attached to and covering one entire side of the wallboard panel, the panel and attached thin sheet of high strength material forming together the entire composite wallboard panel; and securing means for attaching the wallboard panels to the framing studs such that the thin sheet of high strength material sits directly against the framing studs with the securing means penetrating the composite panel underlying the sheet of high strength material and the studs, the thin sheet of high strength material having a strength at least as great as a steel sheet having a thickness within the range of 0.015 to 0.060 inches, the sheet of high strength material being capable of resisting anticipated in-plane or shear loads imposed on the shear wall structure due to environmental conditions such as wind and earthquakes.

2. The composite wallboard panel of claim 1 wherein the thin sheet of high strength material is metal.

3. The composite wallboard panel of claim 2 wherein the metal is steel.

4. The composite wallboard panel of claim 3 wherein the steel sheet has a thickness within the range of 0.015 to 0.06 inches.

5. The composite wallboard panel of claim 2 wherein the wallboard panel is a sheet of gypsum.

6. The composite wallboard panel of claim 1 wherein the thin sheet of high strength material is plastic.

7. The shear wall structure of claim 1 wherein the attaching means comprises screws.

8. The shear wall structure of claim 7 wherein the attaching means comprises nails.

9. A building shear wall structure for accommodating in-plane or shear loads imposed on the wall structure comprising:

a plurality of framing studs forming a part of the building;

a plurality of composite wallboard panels, each composite panel comprising a single gypsum type wallboard panel and one thin steel sheet having a thickness within the range of 0.015 to 0.060 inches, attached to and covering one entire side of the wallboard panel, the panel and attached steel sheet forming the entire composite and wallboard panel; and a plurality of fasteners extending through the composite wallboard panels and into the framing studs so that the steel sheets sit flush against the framing studs, each steel sheet having a strength capable of resisting in-plane or shear loads anticipated to be imposed on the shear wall due to wind and earthquakes.

10. The shear wall structure of claim 9 wherein the fasteners are screws.

11. The shear wall structure of claim 9 wherein the fasteners are nails.

* * * * *

UNITED STATES PATENT AND TRADEMARK OFFICE

CERTIFICATE OF CORRECTION

PATENT NO. : 5,768,841

DATED : 6/23/98

INVENTOR(S) : Allan J. Swartz and Gregory Kulpa

It is certified that error appears in the above-indentified patent and that said Letters Patent is hereby corrected as shown below:

Column 5, line 7, delete "and".

Signed and Sealed this

Tenth Day of November 1998

*Attest:*

*Attesting Officer*

BRUCE LEHMAN

*Commissioner of Patents and Trademarks*